US006520427B1

(12) United States Patent
Chen

(10) Patent No.: US 6,520,427 B1
(45) Date of Patent: Feb. 18, 2003

(54) FLOW CONTROL STRUCTURE OF A PISTOL NOZZLE

(75) Inventor: Chin-Yuan Chen, Chang-Hua Hsien (TW)

(73) Assignee: Shin Tai Spurt Water of the Garden Tools Co., Ltd., Chang-Hua Hsien (TW)

( * ) Notice: Subject to any disclaimer, the term of this patent is extended or adjusted under 35 U.S.C. 154(b) by 0 days.

(21) Appl. No.: 10/050,739

(22) Filed: Jan. 18, 2002

(51) Int. Cl.[7] ..... B05B 7/02
(52) U.S. Cl. ..... 239/526; 239/569; 239/583
(58) Field of Search ..... 239/526, 583, 239/525, 569; 251/102, 103, 110

(56) References Cited

U.S. PATENT DOCUMENTS 3,006,560 A * 10/1961 Rosenkranz ..... 239/526
3,888,421 A * 6/1975 Chow ..... 239/526
4,448,355 A * 5/1984 Roman ..... 239/526
4,619,403 A * 10/1986 Goldney et al. ..... 239/526
5,660,333 A * 8/1997 Strahman et al. ..... 239/526

* cited by examiner

*Primary Examiner*—Michael Mar
*Assistant Examiner*—Dinh Q. Nguyen
(74) *Attorney, Agent, or Firm*—Harrison & Egbert

(57) ABSTRACT

A pistol nozzle is provided with a flow control structure which is formed of a main body, an inner rack, an inner rack, a control lever, and two switching members. The two switching members are used to actuate the outer rack to slide toward one side to engage the inner rack so as to locate securely the control lever. When the outer rack is actuated to slide toward other side to disengage the inner rack, the control lever is set free.

1 Claim, 9 Drawing Sheets

FLOW CONTROL STRUCTURE OF A PISTOL NOZZLE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pistol nozzle, and more particularly to a water flow control structure of the pistol nozzle.

BACKGROUND OF THE INVENTION

As shown in FIG. 1, a pistol nozzle of the prior art comprises a control lever 10 and a retaining piece 11. The control lever 10 is provided with a retaining edge 13. The retaining piece 11 is provided at the bottom end with a rack 12 opposite in location to the retaining edge 13 of the control lever 10. The water flow control of the prior art pistol nozzle is attained by the control lever 10 in conjunction with the retaining piece 11 such that the retaining edge 13 is retained by the rack 12 of the retaining piece 11.

The prior art flow control structure described above is defective in design because the rack 12 of the retaining piece 11 is not properly shielded at all, and because the rack 12 is bound to accumulated or the like, thereby undermining the retaining effect of the rack 12 or the service life span of the rack 12. In addition, the prior art flow control structure is devoid of a means to bring about the disengagement of the retaining edge 13 with the rack 12, thereby making the prior art water flow control structure rather inefficient.

BRIEF SUMMARY OF THE INVENTION

The present invention is intended to overcome the drawbacks of the water flow control structure of the prior art pistol nozzle described above.

In keeping with the principle of the Present invention, the objective of the present invention is attained by a pistol nozzle comprising a flow control structure which is easy to use and durable. The flow control structure comprises a main body, an inner rack, a control lever, an outer rack, and two switching members.

The features and the advantages of the present invention will be more readily understood upon a thoughtful deliberation of the following detailed description of the present invention with reference to the accompanying drawings.

DETAILED DESCRIPTION OF THE INVENTION

Figure 1:
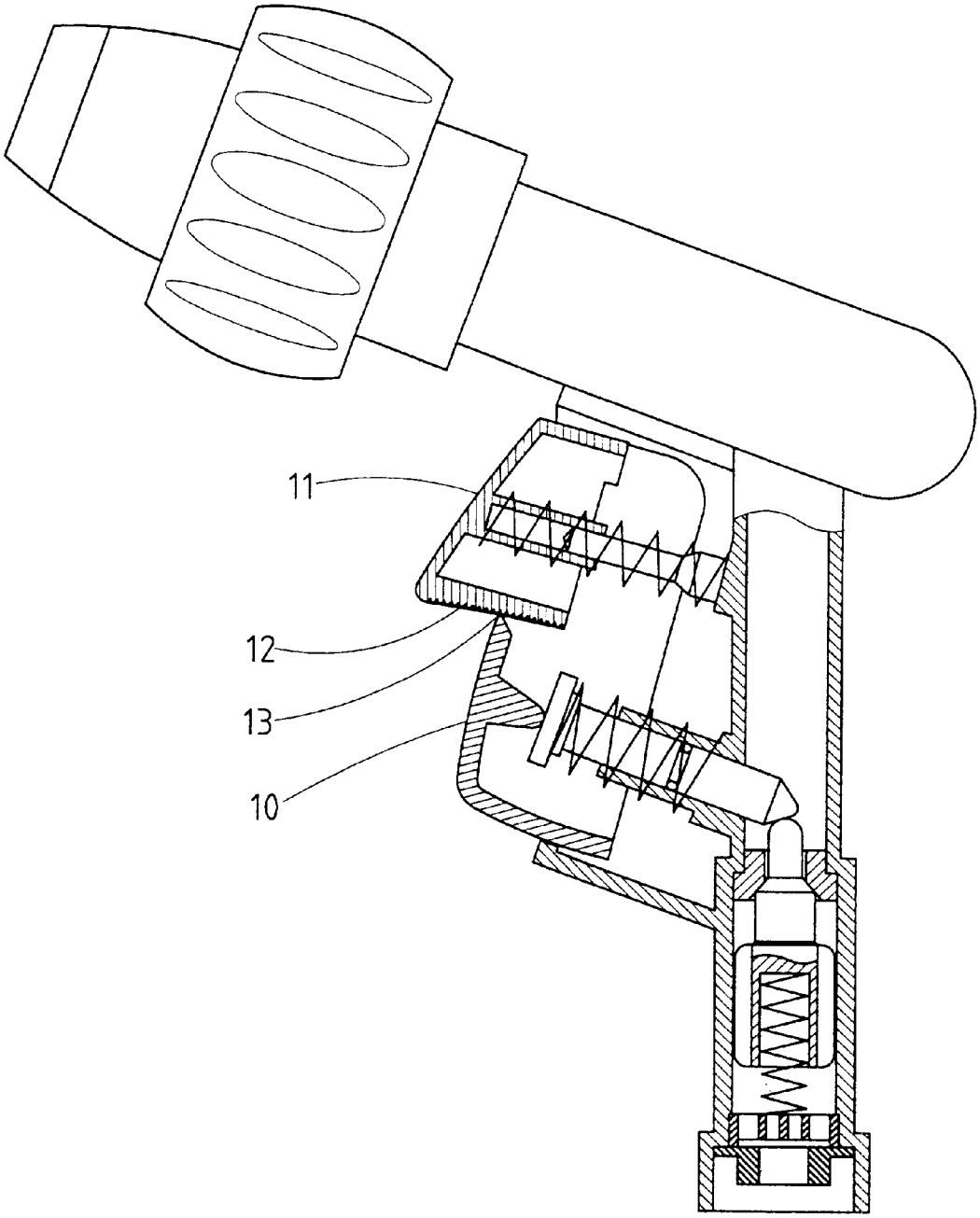
FIG.1 PRIOR ART
FIG. 1 shows a sectional schematic view of a pistol nozzle of the prior art.
Figure 2:
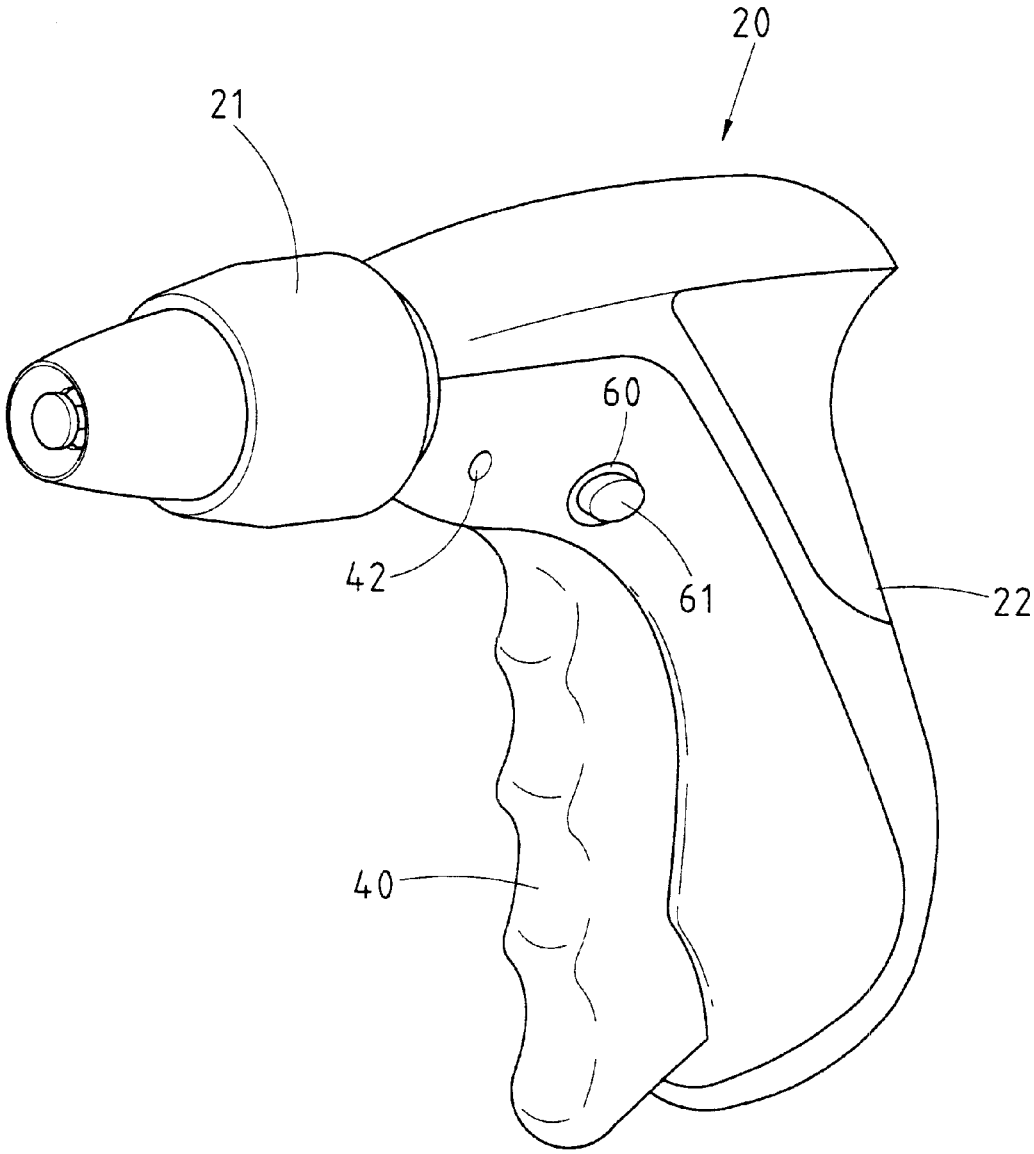
FIG. 2 shows a perspective view of the present invention.
Figure 3:
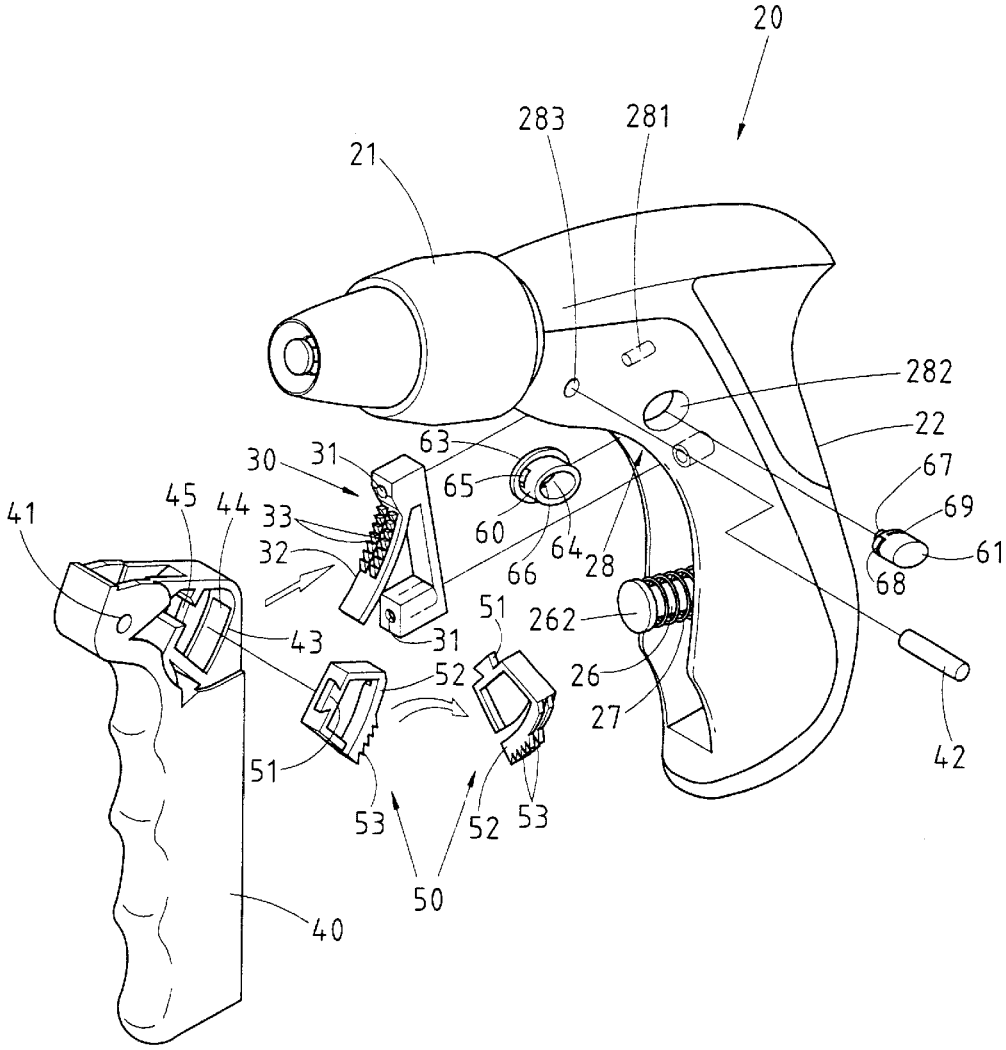
FIG. 3 shows an exploded view of the present invention.
Figure 4:
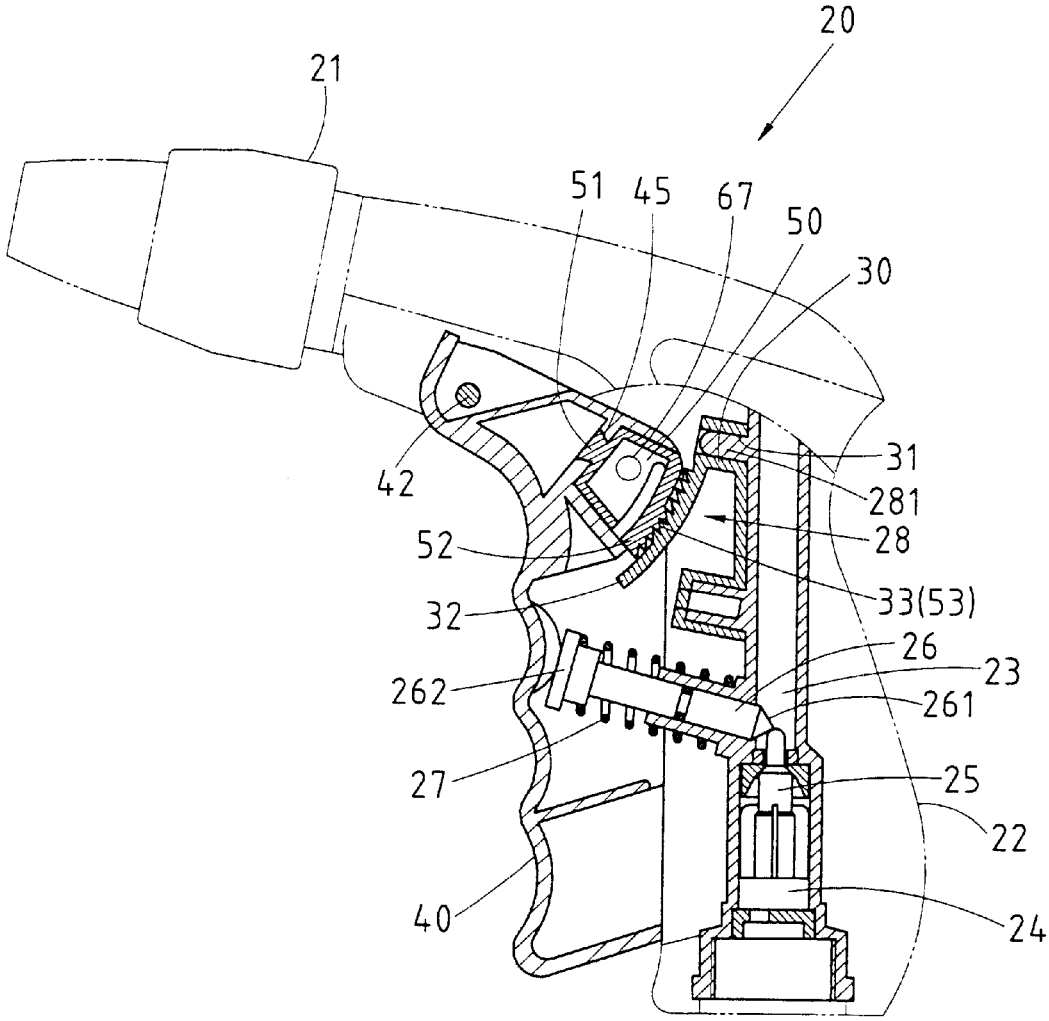
FIG. 4 shows a sectional view of the present invention.

As shown in FIGS. 2–9, a water flow control structure of the present invention comprises a main body 20, an inner rack seat 30, a control lever 40, an outer rack 50, and two switching members.

The main body 20 is formed of a nozzle 21 and a handle 22. The handle 22 is provided in the interior with a water discharging channel 23 and a valve slot 24 which is provided with a valve rod 25 slidably disposed therein for controlling the discharge of water. The water discharging channel 23 is provided in proximity of the valve slot 24 with a link rod 26 pivoted therewith. The link rod 26 has an inner end 261 which is pivoted in the water discharging channel 23 such that the inner end 261 is in contact with the top end of the valve rod 25. The link rod 26 has an outer end 262 which urges a spring 27 in conjunction with the handle 22. The motion of the link rod 26 actuates the valve rod 25 to slide. The link rod 26 is provided with an assembly slot 28 which is in turn provided in the interior with a locating pillar 281, and in two side walls with a through hole 282 and an axial hole 283.

The inner rack 30 is provided in the inner side with a locating hole 31. The inner rack seat 30 is assembled in the assembly slot 28 such that the locating pillar 281 of the assembly slot 28 is inserted into the locating hole 31 of the inner rack 30, and that the outer side of the inner rack 30 forms an elastic rack piece 32 which is provided with two tows of one-way teeth 33.

The control lever 40 is fastened to a front side of the handle 22 and is provided at the top end with a pivoting hole 41. The control lever 40 is fastened pivotally with the handle 22 by a pivot 42 which is received in the pivoting hole 41 of the control lever 40 and the pivoting hole 283 of the handle 22. The control 40 is turned on the pivot 42 serving as fulcrum. The internal side wall of the bottom segment of the control lever 40 presses against the outer end 262 of the link rod 26 of the handle 22. As the control lever 40 is turned, the link rod 26 is driven by the control lever 40. The control lever 40 is provided at the top segment with an assembly slot 43 which is provided with a through port 44 opposite to the rack piece 32 of the inner rack 30, and a horizontally-oriented dovetail slide slot 45.

The outer rack 50 is disposed in the assembly slot 43 of the control lever 40 and is provided with a dovetail block 51 which is slidably disposed in the dovetail slide slot 45 to enable the outer rack 50 to slide horizontally. The outer rack 50 is further provided with an elastic rack piece 52 having two rows of teeth 53. The teeth 53 are engaged with the teeth 33 of the inner rack 30 via the through port 44 of the control lever 40.

The two switching members are formed of a button seat 60 and a press button 61, 62. The button seats 60 are disposed in the through holes 282 of the assembly slot 28 of the handle 22 and are provided with an annular projection 63 which is arrested between the through hole 282 and the control lever 40. The button seat 60 is provided in the center with a through slot 64 which is in turn provided with a stop slot 65 and a locating projection 66. The press buttons 61 and 62 are pivotally disposed in the through slot 64 of the button seat 60. The press buttons 61 and 62 are partially jutted out of the through hole 282 and are provided with a protrusion 67 which is stopped by the outer rack 50. The press buttons 61 and 62 are provided with a protruded block 68 and a recess 69, which are corresponding in location to the stop slot 65 and the locating projection 66 of the through slot 64 of the button seat 60.

Figure 5:
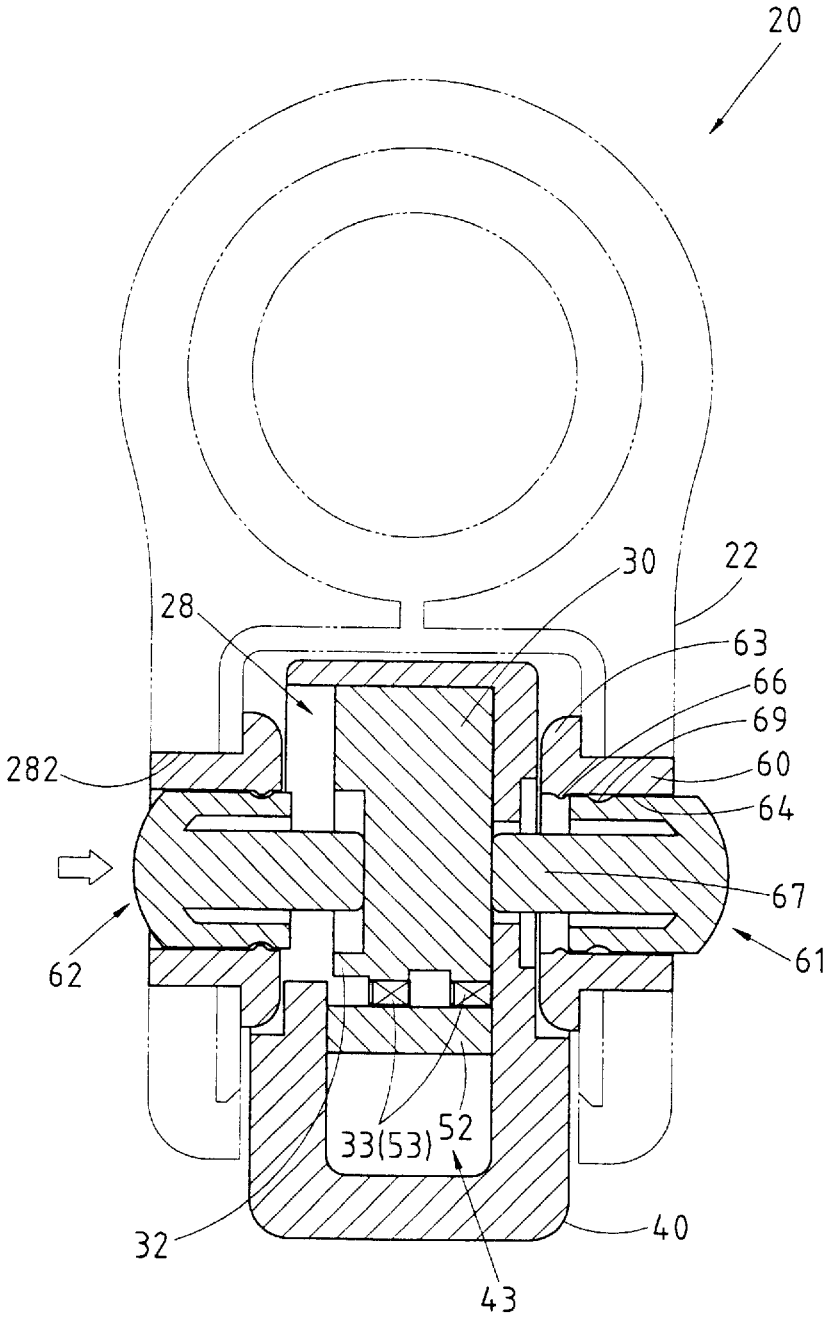
FIG. 5 shows a top sectional view of the present invention.
Figure 6:
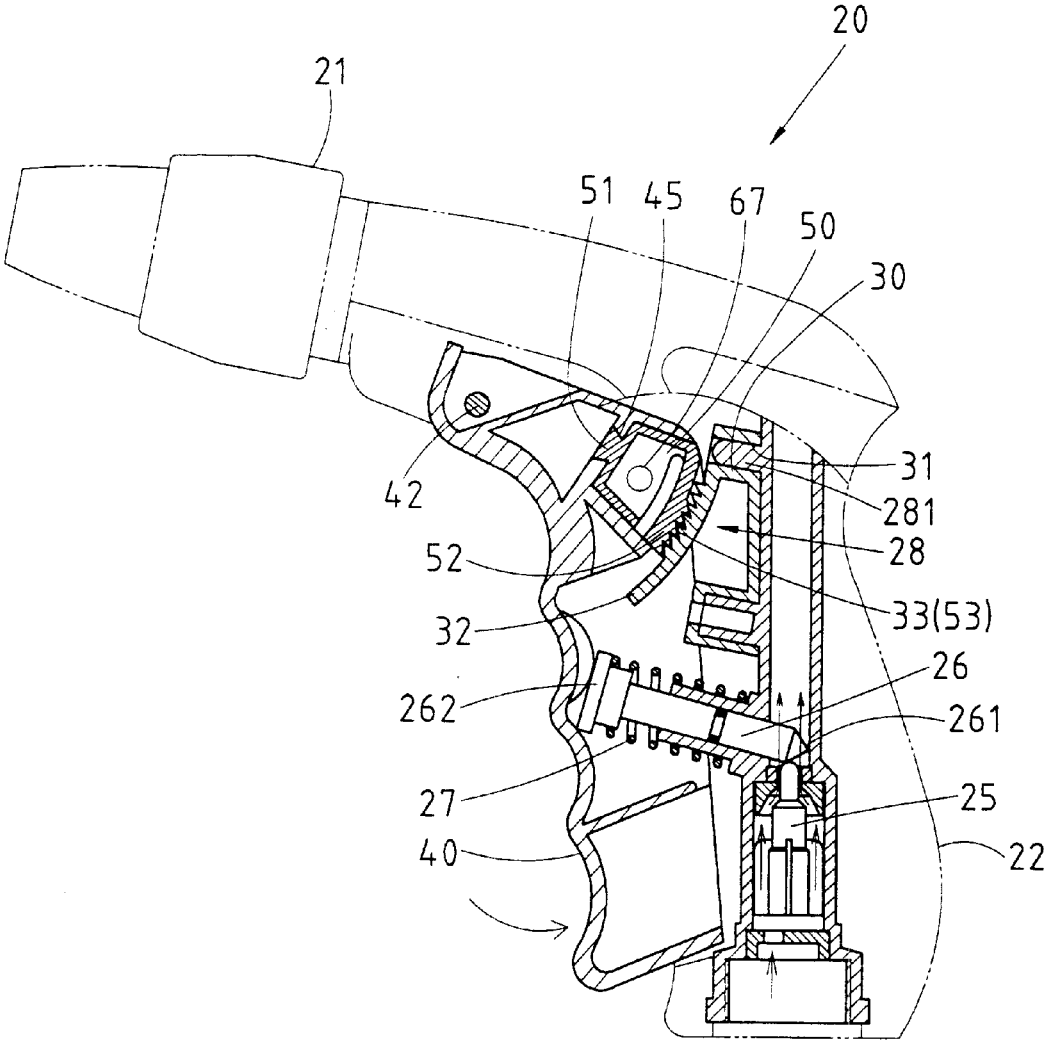
FIG. 6 shows a sectional schematic view of the present in action.
Figure 7:
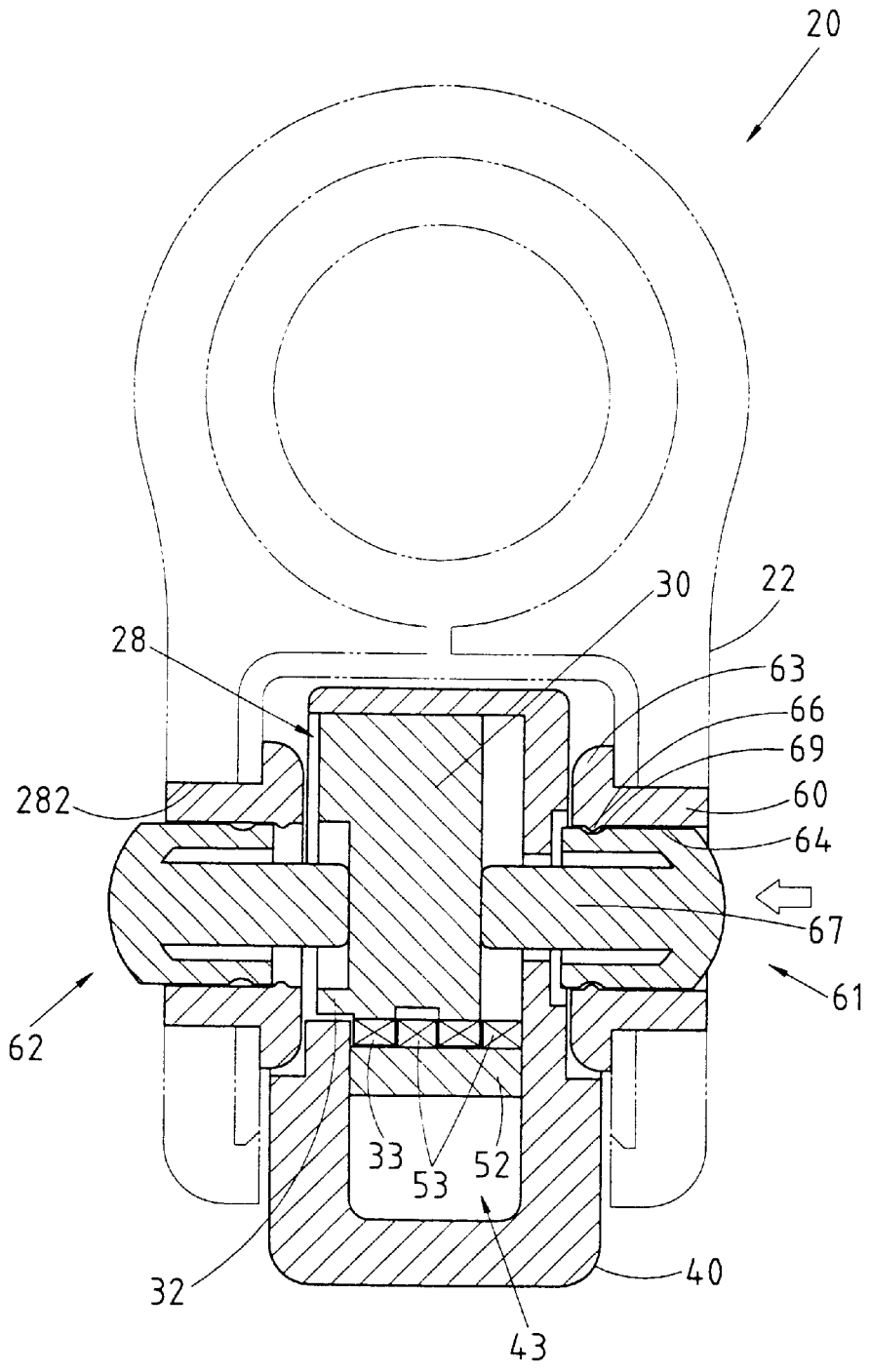
FIG. 7 shows a top sectional view of the present invention in action.
Figure 8:
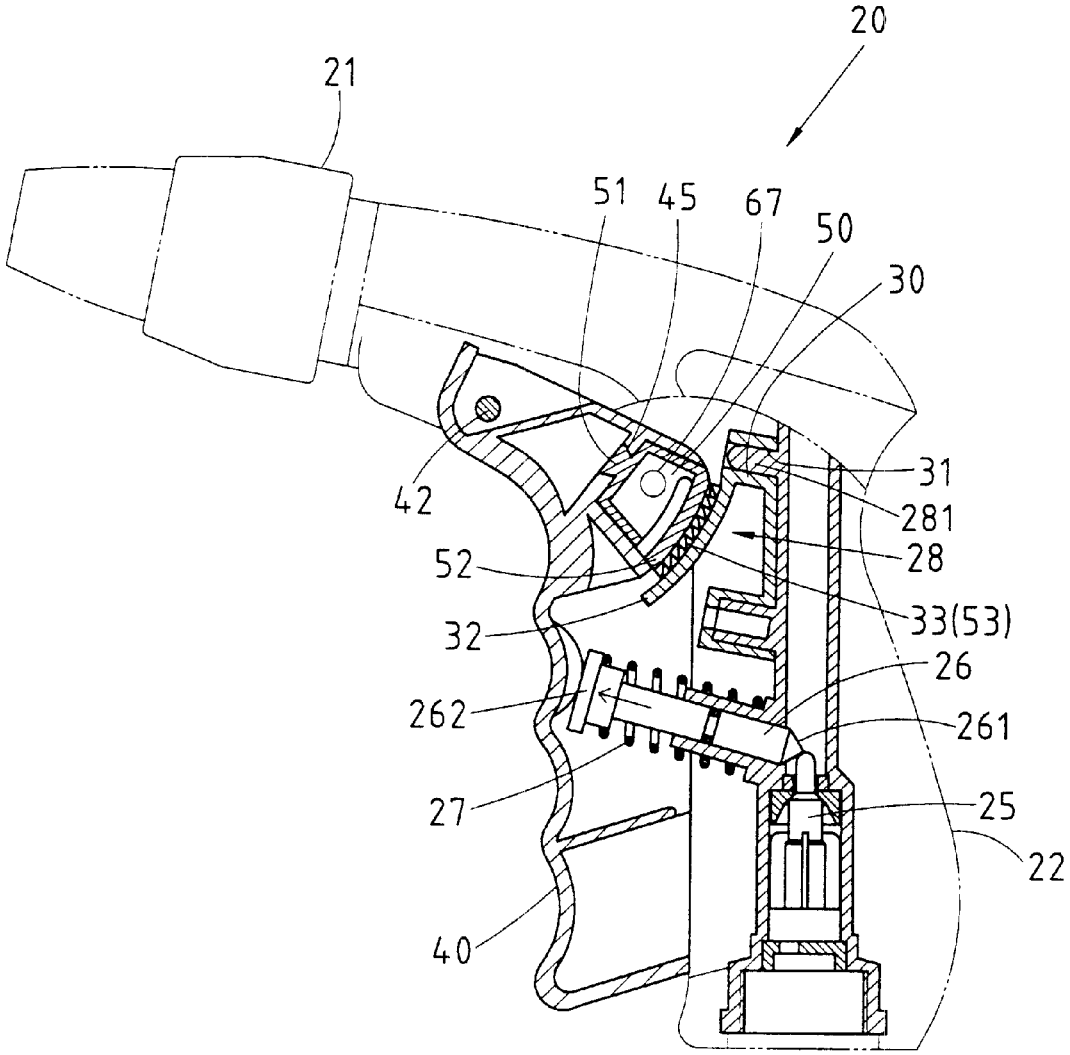
FIG. 8 shows a sectional schematic view of the present invention in action.
Figure 9:
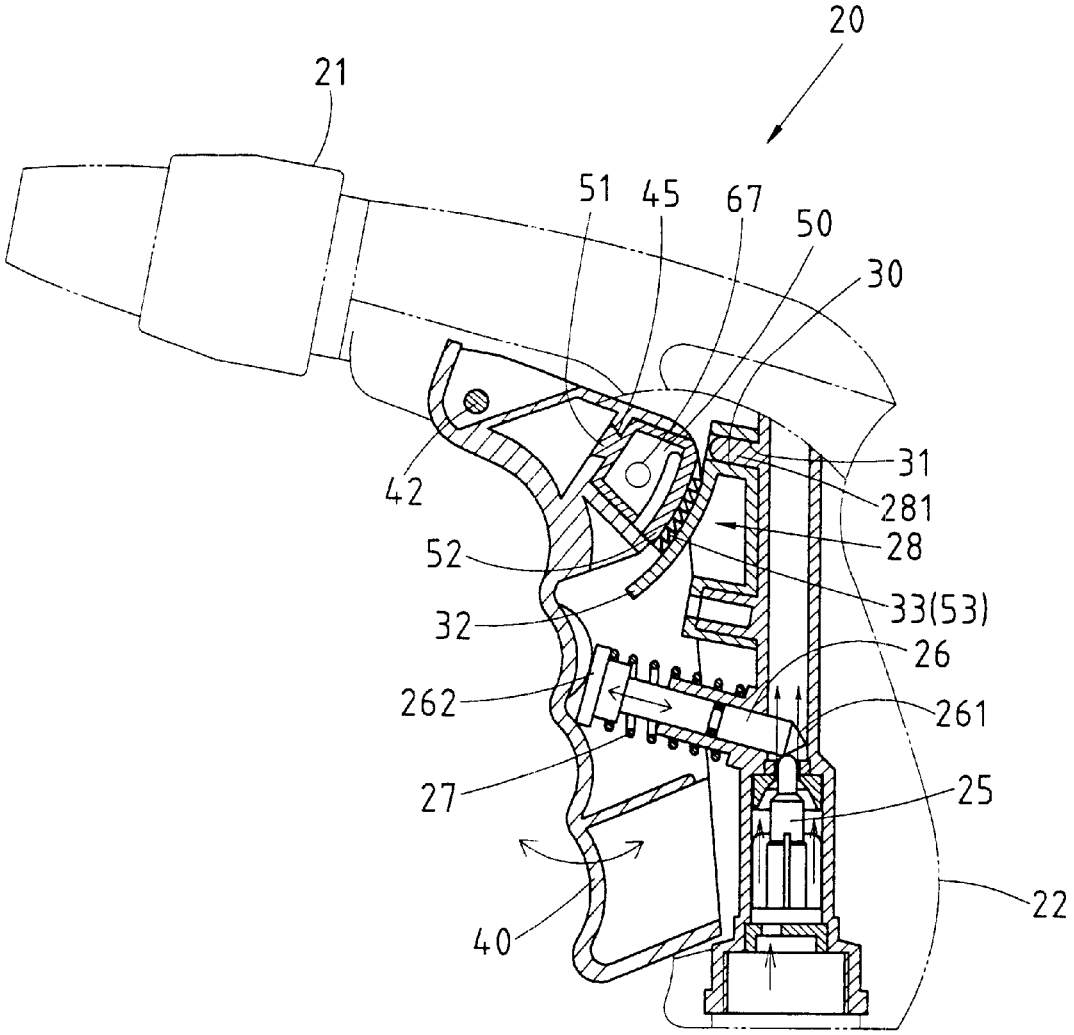
FIG. 9 shows a sectional schematic view of the pre invention in action.

In operation, the press buttons 61 and 62 are pressed to actuate the outer rack 50 to slide so as to control the engagement or disengagement of the one-way teeth 33 of the elastic rack piece 32 of the inner rack 30 with the teeth 53 of the elastic rack piece 52 of the outer rack 50, as shown in FIGS. 5 and 6. When the teeth 33 of the inner rack 30 are engaged with the teeth 53 of the outer rack 50, the control lever 40 is located securely even if the control lever 40 is relieved of an external force exerting thereon. Now referring FIG. 7, when the second press button 61 is pressed, the outer rack 50 slides toward the other side, thereby resulting in disengagement of the teeth 33 of the inner rack 30 with the teeth 53 of the outer rack 50. In the meantime, the control lever 40 and the link rod 26 are forced by the spring 27 to return to their original positions, as shown in FIGS. 8 and 9. The control lever 40 is thus free.

I claim:

1. A flow control structure of a pistol nozzle comprising:

a main body comprised of a nozzle and a handle, with said handle being comprised of, in an interior, a water discharging channel and a valve slot which is comprised of a valve rod slidably disposed therein for controlling the discharge of water, said water discharging channel being comprised of a link rod pivoted therewith, said link rod having an inner end which is pivotally disposed in said water discharging channel such that said inner end of said link rod is in contact with a top end of said valve rod, said link rod further having in outer end which urges a spring in conjunction with said handle, said link rod further comprised of an assembly slot which is in turn comprised of a locating pillar, two through holes located in two side walls thereof, and an axial hole;

an inner rack comprised of, in an inner side, a locating hole and disposed in said assembly slot of said link rod such that said locating pillar of said assembly slot of said link rod is inserted into said locating hole of said inner rack, said inner rack provided in an outer side with an elastic rack piece whereby said elastic rack piece is comprised of two rows of teeth;

a control lever fastened to a front side of said handle and provided at a top end with a pivoting hole by which said control lever is pivotally fastened to said handle in conjunction with a pivot, said pivot being received in said pivoting hole of said control lever to serve as a fulcrum on which said control lever turns so as to drive said link rod, said control lever further provided at a top segment with an assembly slot which is in turn comprised of a through port opposite in location to said elastic rack piece of said inner rack, said assembly slot of said control lever further comprised of a dovetail slide slot;

an outer rack disposed in said assembly slot of said control lever and comprised of a dovetail block which is slidably disposed in said dovetail slide slot of said control lever to enable said outer rack to slide in a horizontal direction, said outer rack further comprised of an elastic rack piece which is in turn comprised of two rows of teeth whereby said teeth of said elastic rack piece of said outer rack are engaged with said teeth of said elastic rack piece of said inner rack via said through port of said control lever; and two switching members, each being comprised of a button seat and a press button, said button seat being disposed in one of said two through holes of said assembly slot of said handle and comprised of an annular projection, said button seat being provided in a center thereof with a through slot which is in turn comprised of a stop slot and a locating projection, said press button being pivoted in said through slot of said button seat such that said press button juts partially out of said through hole of said assembly slot of said handle, said press button comprised of a protrusion which is stopped by said outer rack, said press button further comprised of a protruded block and a recess, with said protruded block being corresponding in location to said stop slot of said through slot of said button seat, and with said recess being corresponding in location to said locating projection of said through slot of said button seat, said press buttons of said two switching members serving to actuate said outer rack to slide toward one side to engage said inner rack so as to locate securely said control lever whereby said control lever is set free at such time when said outer rack is actuated to slide toward outer side so as to disengage said inner rack.

* * * * *